US005081744A

United States Patent [19]

Siegenthaler et al.

[11] Patent Number: 5,081,744

[45] Date of Patent: Jan. 21, 1992

[54] METHOD AND DEVICE FOR CHANGING FIBER SLIVER CONTAINERS ON TEXTILE MACHINES

[75] Inventors: Marcel Siegenthaler, Effretikon; Niklaus Gartenmann, Winterthur, both of Switzerland

[73] Assignee: Maschinenfabrik Rieter AG, Winterthur, Switzerland

[21] Appl. No.: 610,007

[22] Filed: Nov. 7, 1990

[30] Foreign Application Priority Data

Nov. 7, 1989 [CH] Switzerland ..... 04014/89

[51] Int. Cl.[5] ..... D01H 9/18; B65H 67/06

[52] U.S. Cl. ..... 19/159 A; 57/90

[58] Field of Search ..... 19/0.25, 157, 159 R, 19/159 A; 57/90, 261, 276, 277, 281, 408, 409

[56] References Cited

U.S. PATENT DOCUMENTS

| | | | |
|---|---|---|---|
| 3,583,037 | 6/1971 | Krauss et al. | 19/157 X |
| 4,033,104 | 7/1977 | Kamp | 57/90 X |
| 4,150,534 | 4/1979 | Raasch | 57/276 X |
| 4,683,619 | 8/1987 | Langen et al. | 19/159 A |
| 4,688,300 | 8/1987 | Langen et al. | 19/159 A |
| 4,697,310 | 10/1987 | Raasch | 19/159 A |
| 4,735,040 | 4/1988 | Pircher | 57/90 X |
| 4,852,218 | 8/1989 | Lenaertz | 19/159 A |
| 4,922,707 | 5/1990 | Meroni et al. | 57/408 |
| 4,932,201 | 6/1990 | Meroni et al. | 57/90 X |
| 4,956,969 | 9/1990 | Raasch | 57/281 |
| 4,982,563 | 1/1991 | Stahlecker | 19/159 A X |
| 4,998,406 | 3/1991 | Raasch | 19/159 A X |

FOREIGN PATENT DOCUMENTS

| | | |
|---|---|---|
| 0069087 | 1/1983 | European Pat. Off. . |
| 0301330 | 5/1989 | European Pat. Off. . |
| 2646313 | 7/1986 | Fed. Rep. of Germany . |
| 3501875 | 7/1986 | Fed. Rep. of Germany . |
| 3524922 | 1/1987 | Fed. Rep. of Germany . |

OTHER PUBLICATIONS

Standard Search Report 6-8-90.

*Primary Examiner*—Werner H. Schroeder
*Assistant Examiner*—Ismael Izaguirre
*Attorney, Agent, or Firm*—Dority & Manning

[57] ABSTRACT

A transport vehicle with a changing device mounted on it and a method for moving fiber sliver containers from textile delivery machines to a textile processing machine, or vice verse. The changing device comprises a multi-section robot arm with container holders. The textile material containers are placed on depositing places on the transport vehicle, whereby these depositing places are equipped with revolving support plates. Furthermore, a movable catcher device is built on the transport vehicle, by means of which the end of the fiber sliver is caught and is movable. During the conveying operation of the transport vehicle the fiber sliver end is laid in the catcher device through the rotation of the revolving plate. As soon as the changing position for the textile material container has been reached, the container is transferred to the textile processing machine by means of the changing device and the fiber sliver end is transferred by means of the catcher device. Through this changing method and device, the changing operation of textile material holders and the fixing of the sliver end are carried out automatically.

10 Claims, 1 Drawing Sheet

METHOD AND DEVICE FOR CHANGING FIBER SLIVER CONTAINERS ON TEXTILE MACHINES

BACKGROUND OF THE INVENTION

The invention relates to a method for changing fiber sliver containers on textile machines and preparing the end of the fiber sliver for reception in a textile material processing machine. A fiber sliver container is filled with fiber slivers by a textile material delivering machine, the fiber sliver is cut after filling, and the can filled with fiber sliver is transported to a textile material delivering machine and delivered to this machine, as well as a device for the execution of the method.

According to the patent application papers laid open to public inspection no. DE 35 24 922, a device for changing empty textile material containers in the form of cans for filled cans on spinning machines is known. This device is a transport vehicle, on which several cans or textile material containers are deposited one behind the other. A can manipulating device is arranged on the transport vehicle and this device is in the form of a movable gantry carrier along the vehicle with a transverse boom. With this can manipulation device, single textile material containers can be lifted and conveyed between the transport vehicle and the spinning machine and deposited in the position appropriate at the time. The gantry embodiment of the can manipulation device requires considerable space, relatively, and the textile material container can only be placed at right angles to the path of the transport vehicle.

Further difficulties arise when putting down or picking up containers on the spinning machine, as the catcher device for the cans must be conveyed to the container from above and, for this reason, the space for the container must be free from superstructural parts or coverings of the machine. With other machines, this is not possible and this changing device for textile material containers cannot be used in these cases. Furthermore, the disadvantage remains with the use of this can changing device, in that when a filled can is brought to a spinning machine, the end of the sliver must be sought and fixed manually and subsequently brought into the spinning device. Through this requirement the automatic operating sequence is considerably disturbed and machine shutdowns frequently occur.

It is known that the joining of the sliver fiber to a textile material processing machine by means of a built in device can be automated. German patent application no. DE 35 01 875 shows a device of this type which is build onto a spinning machine. The device is arranged on a track over the spinning machine and includes a gripping device for fiber sliver containers as well as auxiliary devices for fixing the end of the fiber sliver. For the actual changing operation of full, or empty cans, a conveyor belt is arranged in the middle of the spinning machine, on which the full, or empty cans are moved along the machine axis. The containers are pushed into the working position on the machine by means of a gripping device arranged on the servicing device. Before the full textile material containers are brought onto the conveyor belt, the end of the fiber sliver is brought to a clamp fitted to the rim of the textile material container and positioned. The gripping device for the container on the servicing device is provided with rollers, by means of which the textile material container can be rotated on its longitudinal axis until the clamp or the end of the fiber sliver lies in a predetermined position. In this position, the textile material container is deposited in its working position on the machine and the joining device arranged on the servicing position can take over the end of the fiber sliver. It is apparent that this device does not permit fully automatic operation, as the end of fiber sliver must be fixed manually on the textile material container. Moreover, the empty and full textile material containers must be removed from, or brought to, the conveyor belt by auxiliary means. A servicing device is necessary on every side of every machine, which leads to a considerable investment. Moreover, this type of textile material container changing is only possible with machines which are designed appropriately and can only be used with combination or total installations with these special machines. All other machines must be operated by other equipment or manually.

A further device for feeding the fiber sliver from a textile material container to a textile machine, in particular a drawing frame, is known from the European Patent Application No. 301 330 A1. With this device, the full textile material containers are placed in parallel in front of the working places of the machines. A hydraulic slider device is assigned to each of the containers in the waiting position. A movable truck with a catcher for the fiber sliver is arranged in a waiting position above the containers. This catcher can be moved on the outer surface of a textile material container and thereby catches an end which is hanging down the side. After picking up the fiber sliver, the catcher lays it on a feeding device on the textile machine. With this known device, the full textile material containers are brought to the machine through a known transport means. The depositing by the machine is clearly effected manually or with conventional auxiliary means, such as slider devices. The containers must first be deposited in a waiting position, so that the fiber sliver end can be sought and passed to the textile machine. In a further stage of operation the full containers are slid into the machine and the empty containers are pushed out by the full ones. This, again, must be carried out manually and the containers removed from the machine with known auxiliary means. This arrangement requires a large amount of space around the machine as a waiting area for the full containers, discharge places for empty containers, and space for the slider device are necessary for every container. Furthermore, the changing operation is time consuming, as several consecutive operational stages are necessary. As the truck with the catcher device for the sliver can only serve one container, the block change described, in which all the containers must be exchanged, is very time consuming. During this time, the machine must be stopped, which leads to high production losses.

SUMMARY OF THE INVENTION

It is the object of the present invention to provide a method and a device, by means of which the changing of textile material containers between various textile machines and the preparation, at the same time, of the fiber sliver for joining can be carried out completely automatically. The method or the movement of the textile material container from one machine to the other for the fixing of the fiber sliver end results at the same time and the changing or the sliding operation for the textile material container as well the fixing of the fiber sliver are carried out and controlled from a transport vehicle and the execution of the necessary processing cycle from the transport vehicle is simplified and the arrangement of the appropriate device and the necessary equipment can be in multiple uses.

The substantial advantages of the invention can be seen in that no auxiliary devices are necessary for the textile delivery machine or on the filled textile material containers for fixing the end of the fiber sliver. The fiber sliver is simply torn off after the filling of the container and allowed to fall over the rim of the textile material container. Thereby, the fiber sliver can be located on any desired place on the periphery of the fiber sliver container. The receiving machine does not require any auxiliary devices to search for the fiber sliver end and bring it from the textile material container to the joining point on the machine. After the fiber sliver has been allowed to fall over the rim of the textile material container, the transport vehicle receives a signal from a control unit that a full textile material container should be carried from a certain depositing position of a textile delivering machine. The transport vehicle is moved automatically into the changing position and the textile material container is removed from the textile machine and transferred to a depositing place on the transport vehicle. On the transport vehicle, a catcher device for the fiber sliver end in the area of the outer shell of the container is brought into a takeover position and the textile material container is rotated on its axis until the fiber sliver end is laid in the catcher device. If these two movements take place simultaneously in the opposite directions, then the fixing operation for the fiber sliver ends is accelerated. If the catcher device moves in the same direction as the container, then the fixing operation is delayed. As soon as the fiber sliver end is laid in the catcher device, the catcher clamps and fixes the fiber sliver. During this clamping and fixing operation of the fiber sliver end on the full textile material container, the transport vehicle is moved to another changing position, for instance on a textile material processing machine, where an empty depositing place for a textile material container is available. Subsequently, the full textile material container is picked up by means of the changing device for the container, likewise arranged on the transport vehicle, and transferred to the empty depositing place on the material accepting textile machine. At the same time, the fiber sliver end is brought into the transfer position through the catcher device, that is, into a position where the joining of the fiber sliver end on the textile processing machine is required. The fiber sliver end is likewise transferred to the machine and the catcher device for the fiber sliver end, as well as the changing device of the textile material container, are retracted into the area of the transport vehicle and are ready for the next changing and/or fixing operation. Waiting space for the container is not required on the material delivering machine or on the material receiving machine. The changing device for the container is not a component of the textile machine but rather, it is arranged on the transport vehicle. For this reason, it is always in that place where containers are being changed and only in that place.

The changing device for the fiber sliver container and the catcher device for seeking and fixing of the fiber sliver end are used repeatedly with this arrangement on the transport vehicle, as they are employed with every changing operation. For both functions, only a positioning of the container and the auxiliary devices are necessary in each case. On the individual machines, no corresponding auxiliary means are required, which leads to a substantial saving of the investment required. With a large number of machines, several transport vehicles can be used, whereby the combination of different textile machines is possible, without problems. The changing operation of the textile material container and the fixing of the textile sliver end is not determined through the machine type, but rather it results in every case through the stages of the operation of the devices arranged on the transport vehicle.

The method according to the invention and the appropriate devices make possible a fully automated process cycle of the changing operation of the container and the fixing operation of the fiber sliver end. Through this, the optimum use of the appropriate devices is possible. This leads to higher operating reliability and to improved profitability of the whole installation. No manual operations are necessary for the changing of the textile material container and the fixing and the transfer of the fiber sliver into the joining position, as all these operations are carried out fully automatically by a device that is, according to the invention, for different textile machines, from an automatically moved transport vehicle.

The movement area, which is taken up by a changing position of the transport vehicle for the textile material container, covers substantially one depositing place on the transport vehicle and the appropriate depositing place on the textile machine from which a textile material container should be removed form or put down. In order to cover this movement area, the changing device has a robot arm with container holders. The catcher device for the fiber sliver end is, for its part, displaceable in the movement area, which covers at least one depositing place for textile material containers on the transport vehicle as well as the corresponding changing position assigned on the transport vehicle for the textile material container filled with fiber sliver. In addition, the catcher device is still movable in the area in which the joining device for the fiber sliver end is arranged.

If there are two depositing places available on the transport vehicle and the changing devices and the catcher devices are movable in the area of both depositing places, then an optimal operating sequence results. The robot arm for the changing device as well as the carrier and direction of movement for the catcher device are executed in the conventional way and comprise, for instance, of multi-section carrier arms with appropriate driving, controlling and sensor elements. The transport vehicle also has known drive arrangements as well as control units, which make possible the automatic process between the different material container depositing places and the textile machines as well as the positioning and stopping of the transport vehicle in the desired changing positions.

BRIEF DESCRIPTION OF THE DRAWING

In the following, the invention, as well as further advantages and details are more closely explained with the aid of the attached drawing, in which.

DETAILED DESCRIPTION OF THE PREFERRED EMBODIMENT

Figure 1:
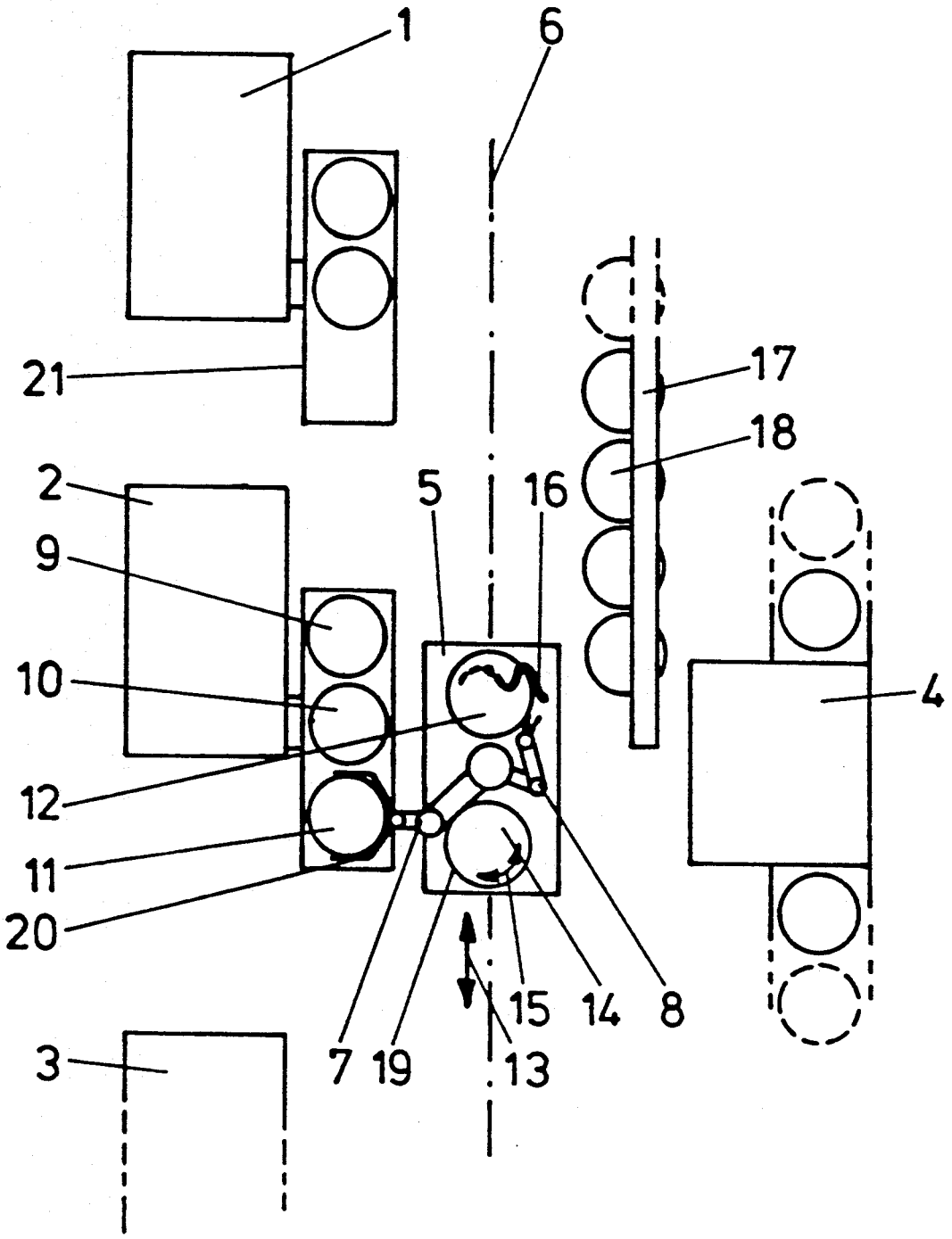
FIG. 1 is a schematic simplified view of an arrangement of different textile machines and a transport vehicle according to the invention.

Carding machines 1, 2 and 3 are arranged as textile material delivering machines. Each of these cards 1, 2 and 3 has a magazine 21 for textile material containers, or cans, 9, 10 and 11. Thereby, with the card 2 or its can magazine 21, this is a matter with the container or can 9 filled with fiber sliver, with the container or can 10 with which the filling operation has just started and with the container or can 11 empty. There are one or more draw frames 4 arranged opposite to and parallel with the cards 1, 2 and 3. In the embodiment represented, only one draw frame 4 is shown, whereby this draw frame extends over a feed table 17 with filled cans, from which fiber sliver is drawn and conveyed to the draw frame 4. Between the cards 1, 2, 3 and the draw frame 4, there is a transport vehicle 5, which is automatically movable along a driving axis 6 on a predetermined track.

There are two depositing places 19 for textile material containers on this transport vehicle 5. The depositing places 19 each have a revolving plate 14, which is rotated in the direction of the arrow 15. In the embodiment represented, one of the depositing places 19 is empty and on the second there is a filled can 12. With this can 12, the fiber sliver 16 hangs loosely over the rim of the can and is to be found in the area of the outer shell of the can 12. There is a changing device 7 arranged between the two depositing places 19 for moving the textile material containers or cans from the transport vehicle 5 to an appropriate depositing place on a textile machine and vice versa. This changing device 7 consists of a multi-section robot arm with container or can holders 20 on the outermost end. With the aid of these container holders 20, a textile material container can be grasped, then lifted with the changing device 7 and moved. In addition, a sliver catcher device 8 is arranged to catch the fiber sliver end between the depositing places 19. Catcher 8, likewise, comprises a multisection robot arm with a sliver clamp arranged on its end. The changing device 7 and the catcher device 8 has sensors (not shown) for position determination, driving, and control devices.

In FIG. 1, there is shown a transport vehicle 5 in a changing position, which is aligned with the depositing place with the empty cans 11 on the card 2. This empty can 11 is moved from the empty depositing place 19 on the transport vehicle 5 and placed into the position represented in the can magazine 21 of the card 2 with the aid of the changing device 7. Through opening the container holders 20, the can 11 is put down and the changing device 7 is subsequently retracted into the area of the transport vehicle 5. In the embodiment represented, there is an empty can 18 in the draw frame 4, on its feed table 17 which must be replaced by a full can. However, an empty reserve place can be provided on the draw frame 4. The transport vehicle 5 is now moved from the position represented into the changing position, which is assigned to the empty textile material container 18 or to the empty reserve place on the feed table 17 represented by the broken line position.

During this operation, the filled can 12 on the transport vehicle 5 is rotated on its longitudinal axis by means of the revolving plate 14, on which it is put down. In addition, the bottom of the material container 12 and the revolving plate 14 act on the transport vehicle 5 and have a mating driving connection which is not shown. At the same time, the catcher device 8 is brought into the desired position on the outer shell of the can 12. The can 12 is now rotated on its longitudinal axis until the fiber sliver end 16 is laid in the catcher device 8 and sensors on catcher device 8 detect the presence of the sliver end 16. At this moment, or after a predetermined delay, the fiber sliver end 16 on the catcher device 8 is clamped and the rotary movement of the can 12 is stopped. If the searching or fixing operation of the sliver is accelerated, then the catcher device 8 is additionally moved against the direction of rotation of the can 12. A chronological delay of the fixing operation of the fiber sliver 16 is possible, in that the catcher device 8 is moved in the same direction as the can 12, however at a lower speed.

During the moving of the transport vehicle 5, the changing device 7 is brought into a position in which it does not impede the conveying operation of the transport vehicle 5; however, it can subsequently grasp the textile material container as rapidly as possible. As soon as the transport vehicle 5 has reached the new changing position, it is held there, and the changing device 7, or its container holders 20 are moved outward and grasp the textile material containers 18. This empty textile material container 18 is now put in the empty depositing place 19 on the transport vehicle 5. Subsequently, the changing device is conveyed in such a way that the holders 20, which are already to be found on the transport vehicle 5 grasp the full can 12. The full can 12 is now moved into the depositing place on the feed table 17 by means of the changing device 7, in which the can 18 has previously been deposited. At the same time the can 12 is brought to a transfer position on the feed table 17 of the draw frame 4 with the aid of the catcher device 8. In this transfer position on the feed table 17, a joining device is to be found, which can take over the fiber sliver 16 and feed it into the textile processing machine, in this case the draw frame 4. As soon as the can 12 is put down on the feed table 17 and the fiber sliver end 16 has been transferred to the joining device, the changing device 7 and the catcher unit device 8 are retracted into the area of the transport vehicle and the transport vehicle is ready for a new changing operation. According to the number of can depositing places on the machine and the corresponding reserve places, it is also possible to provide only one depositing place on the transport vehicle. The travelling motions of the transport vehicle are then appropriately controlled and optimized.

It is clear that the arrangement of the changing device 7 for the textile material container and the catcher device 8 for the fiber sliver end 16 on the transport vehicle 5 and the combination of these devices with the two depositing places 19 on the transport vehicle leads to an extremely compact embodiment of these auxiliary means. At the same time, all these single devices are used as intensively as possible, as they are employed in every changing operation. On the cards 1, 2, 3 or the draw frame 4, no additional changing devices or catcher devices are necessary, which leads to savings and simplifications on every machine. In the case of disturbances of the changing device 7, the catcher device 8 or the revolving plates 14, the textile machines 1, 2, 3 or 4 need not be stopped, but rather the transport vehicle 5 can be replaced with a reserve vehicle, that is, the operation of the textile machine need not be interrupted. This leads to higher operating reliability and a better efficiency factor for the entire installation. Since the seeking and fixing of the fiber sliver end 16 on filled cans 12 takes place during the conveying operation of the transport vehicle 5, additional time is saved, since the filled cans 9 can be taken automatically from one of the cards 1, 2, 3, without first fixing the fiber sliver at the card. The filled cans 9 on the end of the transport vehicle can be transferred directly to the draw frame 4, as all the preparatory operations have already been carried out during the transport and the sliver end 16 is now fixed. This simplifies the whole process cycle and, in particular, makes the saving of additional manual operations possible.

What is claimed is:

1. A method of changing fiber sliver containers on textile machines having magazines for supporting a plurality of said sliver containers and preparing an end of fiber sliver carried in said containers for feeding said sliver to a textile material processing machine having a feed table positioning a plurality of sliver containers, said containers having a rim and an outer shell, comprising the following steps:

(a) filling at least one sliver container with fiber sliver on a magazine;

(b) transferring a filled sliver container from said magazine to a transport vehicle disposed adjacent to said magazine;

(c) dropping said end of said fiber sliver over the rim adjacent the outer shell of said sliver container, (d) replacing said filled sliver container with an empty sliver container;

(e) moving said transport vehicle to a point adjacent to said feed table;

(f) catching and clamping said end of said fiber sliver of said filled sliver container while said transport vehicle moves from said magazine to said feed table;

(g) moving said end of sliver into a transfer position;

(h) transferring said filled sliver container to said feed table; and (i) transferring said sliver end to said textile material processing machine for processing said textile fiber sliver material.

2. A method as set forth in claim 1, including the further step of rotating said filled sliver container about a longitudinal axis of said container on a revolving plate supported on said transport vehicle while said transport vehicle moves from said magazine to said feed table.

3. A method as set forth in claim 1, including the further steps of sensing, catching and clamping of said end of said fiber sliver.

4. A method as set forth in claim 1, including the further step of transferring empty sliver containers from said feed table to said transport vehicle.

5. A system for changing fiber sliver containers on textile machines and preparing an end of the fiber sliver for reception in a textile material processing machine, comprising:

(a) at least one textile material delivering machine for delivering textile material into a fiber sliver container;

(b) a magazine for retaining a plurality of fiber sliver containers, at least one of said containers is in a position to be filled with fiber sliver by said textile material delivering machine;

(c) at least one textile material processing machine for processing fiber sliver drawn from one or more fiber sliver containers;

(d) a feed table disposed adjacent to said textile material processing machine having means to support a plurality of sliver containers;

(e) a transport vehicle disposed between said magazine and said feed table for transporting a plurality of sliver containers from said magazine to said feed table and from said feed table to said magazine;

(f) a container changing device disposed on said transport vehicle positioned for transferring filled sliver containers from said magazine to said transport vehicle and empty sliver containers from said transport vehicle to said magazine and for transferring filled sliver containers from said transport vehicle to said feed table and empty sliver containers from said feed table to said transport vehicle;

(g) a sliver catcher device disposed on said transport vehicle for clamping and holding a fiber sliver end on a filled fiber sliver container on said transport vehicle and for transferring said fiber sliver end to said textile material processing machine when said fiber sliver container is transferred to said feed table; and (h) control means for controlling the movement of said transport vehicle between said magazine and said feed table and for controlling the movements of said container changing device and said sliver catcher device, to transport sliver containers to and from said magazine and said feed table.

6. A system as set forth in claim 5, wherein said fiber sliver containers are supported on said transport vehicle by revolvable plates.

7. A system as set forth in claim 6, wherein said sliver containers have bottom revolvable plates and the bottom of said sliver containers are shaped in mating driving connections.

8. A system as set forth in claim 7, wherein said revolvable plate including driving means and is driven while said transport vehicle moves from said magazine to said feed table until said sliver catcher clamps said fiber sliver end.

9. A system as set forth in claim 5, wherein said catcher device is disposed on said changing device.

10. A system as set forth in claim 5, wherein said sliver containers are supported on revolvable plates on said transport vehicle.

* * * * *